US009689125B1

(12) United States Patent
Rempel

(10) Patent No.: US 9,689,125 B1
(45) Date of Patent: Jun. 27, 2017

(54) PET WASTE COLLECTION APPARATUS

(71) Applicant: Mike Rempel, Abbotsford (CA)

(72) Inventor: Mike Rempel, Abbotsford (CA)

( * ) Notice: Subject to any disclaimer, the term of this patent is extended or adjusted under 35 U.S.C. 154(b) by 0 days.

(21) Appl. No.: 15/174,113

(22) Filed: Jun. 6, 2016

Related U.S. Application Data

(60) Provisional application No. 62/170,760, filed on Jun. 4, 2015.

(51) Int. Cl.
*E01H 1/04* (2006.01)
*E01H 1/12* (2006.01)
*E01H 1/00* (2006.01)

(52) U.S. Cl.
CPC ..... *E01H 1/006* (2013.01); *E01H 1/045* (2013.01); *E01H 1/047* (2013.01); *E01H 2001/1293* (2013.01)

(58) Field of Classification Search
CPC ..... E01H 1/006; E01H 1/045; E01H 1/047; E01H 1/106; E01H 1/1206; E01H 2001/122; E01H 2001/1226; E01H 2001/1293; A01G 1/125
USPC ..... 294/1.4; 414/440; 15/79.1; 56/400.02
See application file for complete search history.

(56) References Cited

U.S. PATENT DOCUMENTS 425,695 A * 4/1890 Pontious ..... A01D 76/006 15/79.1
1,224,349 A 5/1917 Yessne
1,580,600 A 4/1926 Holbrook
2,244,848 A * 6/1941 Olds ..... E01H 1/045 15/83
2,525,090 A 10/1950 Bott
3,591,883 A * 7/1971 Armstrong ..... E01H 1/047 15/149
3,978,545 A * 9/1976 Morel ..... A01D 90/00 15/83
4,042,994 A * 8/1977 Sassaman ..... E01H 1/045 15/79.1
4,106,703 A 8/1978 Magda
4,366,593 A * 1/1983 Parikh ..... A47L 11/22 15/49.1
4,765,666 A 8/1988 Parks
4,966,400 A 10/1990 Hull et al.
7,270,157 B2 9/2007 Perkitny
8,201,863 B1 6/2012 Konovalov
2007/0024070 A1 * 2/2007 Aihiokhai ..... E01H 1/0845 294/1.4

FOREIGN PATENT DOCUMENTS

GB 211558 * 2/1924

* cited by examiner

*Primary Examiner* — Dean Kramer
(74) *Attorney, Agent, or Firm* — Robert C. Montgomery; Montgomery Patent & Design LP.

(57) ABSTRACT

A pet waste collection apparatus includes a mobile housing assembly defining an interior, a pick-up roller disposed within the interior, wherein the pick-up roller is configured to collect solid waste, a plurality of fragmentation rollers disposed within the interior upstream from the pick-up roller, wherein the plurality of fragmentation rollers is configured to progressively break up the solid waste, and a hopper disposed within the interior, wherein the plurality of fragmentation rollers transfer the solid waste into the hopper.

15 Claims, 5 Drawing Sheets

PET WASTE COLLECTION APPARATUS

RELATED APPLICATIONS

The present invention claims the benefit of U.S. Provisional Application No. 62/170,760 filed on Jun. 4, 2015, the entire disclosures of which are incorporated herein by reference.

FIELD OF THE INVENTION

The present invention relates generally to pet waste disposal and, more particularly, to a portable pet waste collection and disposal apparatus.

BACKGROUND OF THE INVENTION

The act of walking a dog or other pet is a pleasure enjoyed by many pet owners. The ability to get outside and experience nature and the surroundings is a simple joy. There are also the great health benefits associated with exercise for both the dog and the human walker. However, one (1) additional task associated with walking of a dog is the cleaning up of droppings. This act is not only the responsible thing to do, but it is the sanitary thing to do as well. Such droppings are usually picked up in a bag, and then placed in the nearest trash can where they add to the waste stream, and take up space in landfills. Others, with their own yards, may choose to let Mother Nature take its course, and allow such droppings to break down on their own where they act like fertilizer. However, the feces remain an eyesore as well as a sanitation hazard for days or weeks until such breakdown happens.

Accordingly, there exists a need for a means by which dog droppings can be picked up to avoid a sanitation, and eyesore hazard, but still be used as an ecologically friendly fertilizer.

SUMMARY OF THE INVENTION

The inventor has recognized the aforementioned inherent problems and lack in the art and observed that there is a need for a waste collection apparatus that provides dog owners an effective means to clean up pet droppings during a walk in an ecologically friendly manner. The development of the present invention, which will be described in greater detail herein, substantially departs from conventional solutions to fulfill this need.

In one (1) embodiment, the disclosed pet waste collection apparatus includes a mobile housing assembly defining an interior, a pick-up roller disposed within the interior, wherein the pick-up roller is configured to collect solid waste, a plurality of fragmentation rollers disposed within the interior upstream from the pick-up roller, wherein the plurality of fragmentation rollers is configured to progressively break up the solid waste, and a hopper disposed within the interior, wherein the plurality of fragmentation rollers transfer the solid waste into the hopper.

In another embodiment, the disclosed pet waste collection apparatus includes a mobile housing assembly defining an interior, a push handle attached to the housing assembly, an axle connected to a front of the housing assembly, a pair of wheels connected to opposed ends of the axle, a pair of casters rotatably connected to the housing assembly rearward of the pair of wheels, a collector assembly attached to the housing assembly and configured to collect solid waste from a ground surface, a pick-up roller disposed around the axle within the interior, wherein rotation of the wheels causes rotation of the pick-up roller, and wherein the pick-up roller is configured to engage the collector assembly, a plurality of fragmentation rollers disposed within the interior and upstream from the pick-up roller, wherein the pick-up roller is configured to transfer the solid waste from the collector assembly to the plurality of fragmentation rollers, and wherein the plurality of fragmentation rollers is configured to progressively break up the solid waste, a drive train mechanically interconnecting the pick-up roller and the plurality of fragmentation rollers, wherein rotation of the pick-up roller causes rotation of the plurality of fragmentation rollers, and a hopper disposed within the interior and upstream from the plurality of fragmentation rollers, wherein the plurality of fragmentation rollers transfer the solid waste into the hopper.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
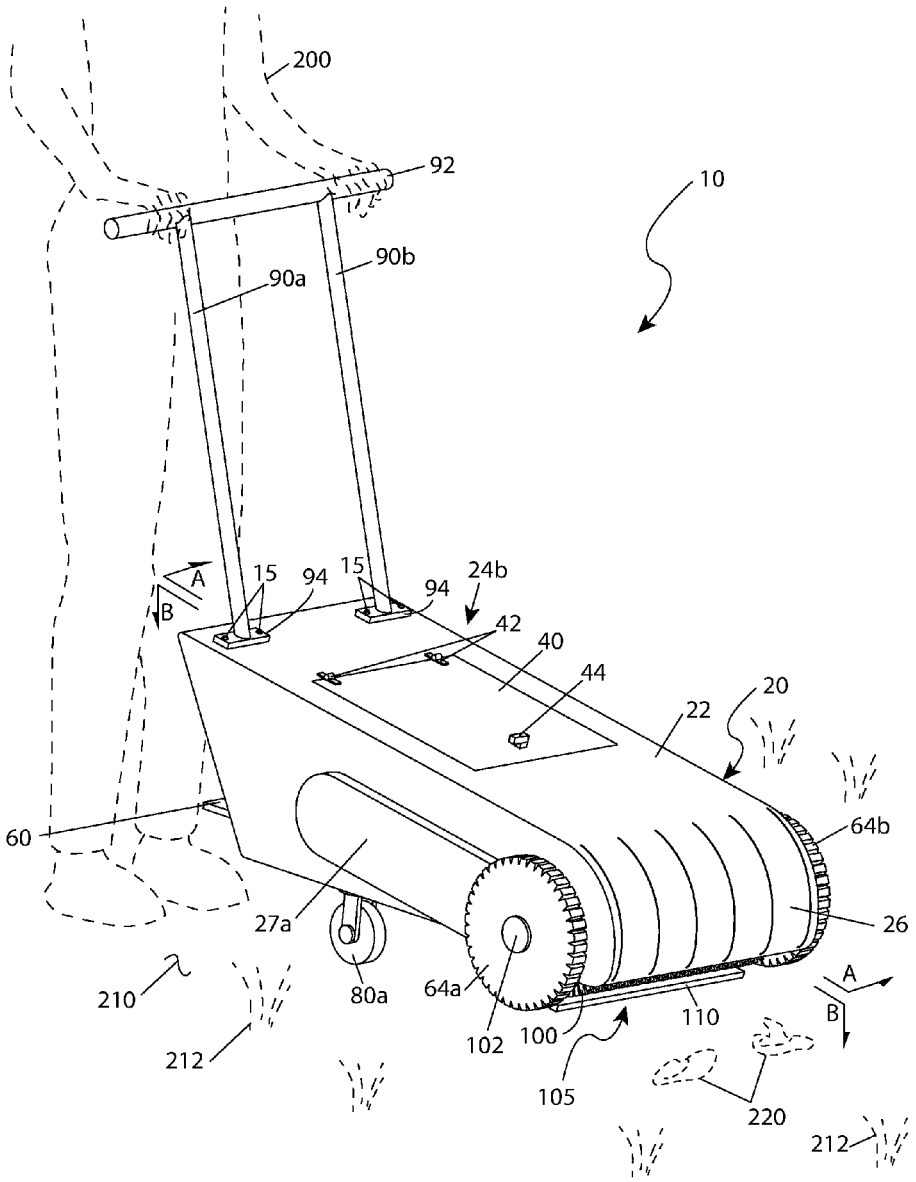
FIG. 1 is an environmental front perspective view of a pet waste collection apparatus, according to a preferred embodiment of the present invention.

10 pet waste collection apparatus
15 fastener
20 housing assembly
22 top panel
24*a* first side panel
24*b* second side panel
26 front panel
27*a* first access cover
27*b* second access cover
28 bottom panel
30 rear panel
34 top opening
40 top door
42 top door hinge

44 top door latch
46 hopper
48 hopper opening
50 rear door
52 rear door hinge
54 rear door latch
56 rear opening
60 slide plate
62 slide plate handle
64*a* first wheel
64*b* second wheel
68 tread
80*a* first caster
80*b* second caster
90*a* first push handle support
90*b* second push handle support
92 push handle
94 mounting bracket
100 pick-up roller
101 bristle
102 front axle
103 first gear
104 roller body
105 collector assembly
106 pick-up arm
110 collector plate
112 front edge
116 mounting flange
120 drive train
130 first fragmentation roller
132 first roller shaft
133 second gear
140 second fragmentation roller
142 second roller shaft
143 first sprocket
146 second sprocket
150 third fragmentation roller
151 pulverizing surface
152 third roller shaft
153 third sprocket
155 drive chain
200 user
210 ground surface
212 ground cover
220 pet feces
230 travel path

DETAILED DESCRIPTION OF THE PREFERRED EMBODIMENT

In accordance with the invention, the best mode is presented in terms of a preferred embodiment, herein depicted within FIGS. 1 through 5. However, the invention described herein is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

Referring to FIGS. 1-5, disclosing a pet waste collection apparatus (herein described as an apparatus) 10, where like reference numerals represent similar or like parts. The disclosed apparatus 10 lifts pet feces 220 from a ground surface 210; fragments the pet feces 220; and, collects the pet feces 220 for subsequent disposal or re-distribution upon a ground surface 210 as a fertilizer.

As used herein, relative terms such as "front," "rear," "left," "right," "top," "bottom," "below," "above," "upper," "lower," "horizontal," "vertical," and similar terms are used to describe a relationship of one element, feature and/or region to another element, feature and/or region, as illustrated in the figures. For example, in the ensuing description, reference to a front of the apparatus 10 indicates a portion of the apparatus 10 that is opposite a user 200 during use and reference to a back, or rear, of the apparatus 10 indicates a portion of the apparatus 10 that is adjacent to the user 200 during use (i.e., the portion to which a push handle 92 is attached).

Figure 2:
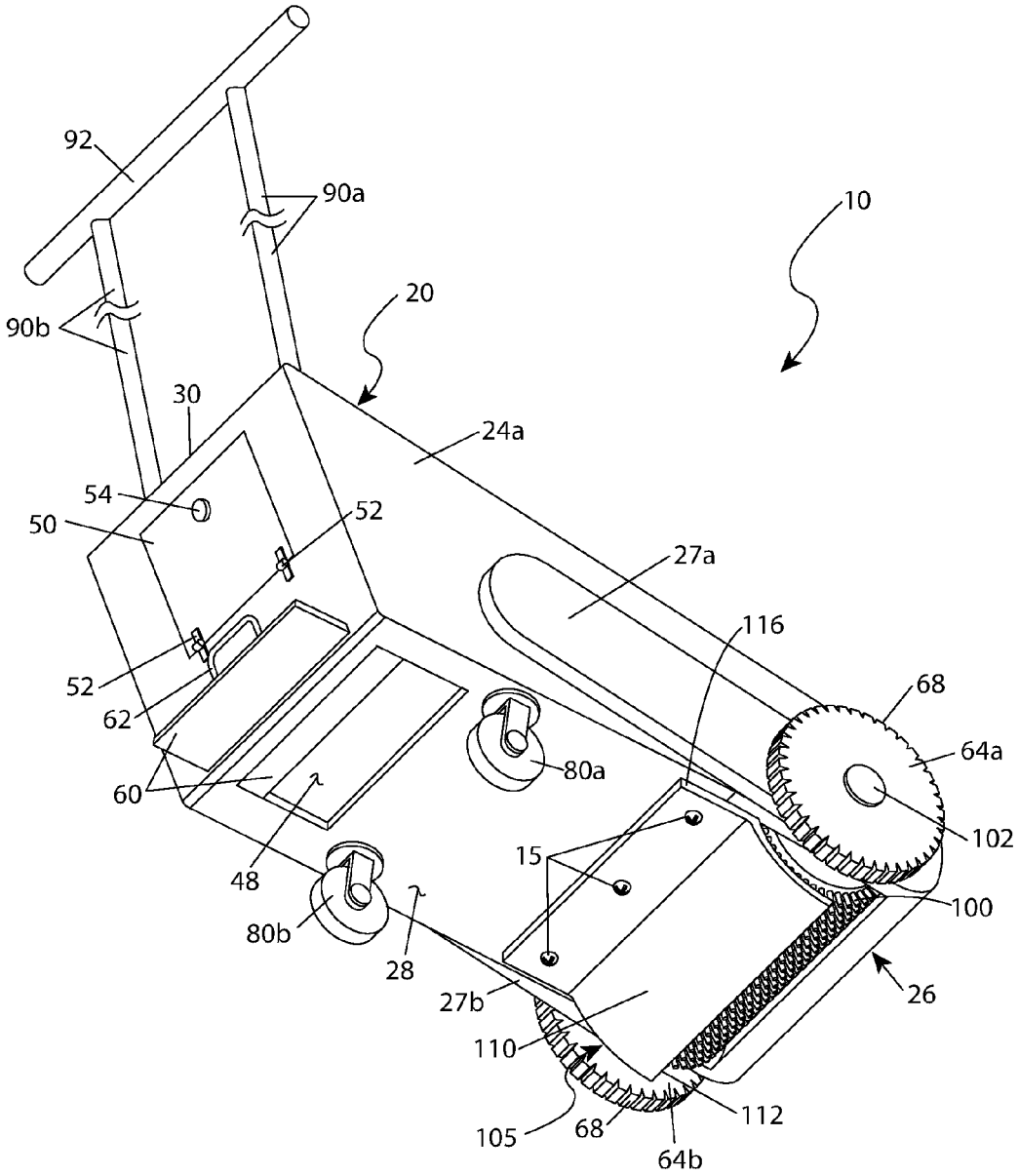
FIG. 2 is a bottom perspective view of the pet waste collection apparatus, according to a preferred embodiment of the present invention.

Referring now to FIGS. 1 and 2, an environmental front perspective view and a bottom perspective view, respectively, of the apparatus 10, according to the preferred embodiment of the present invention, are disclosed. Generally, the apparatus 10 is a walk-behind, pushed tool, which includes a low-profile housing assembly 20 and the push handle 92. The apparatus 10 is capable of being maneuvered by the user 200 across the ground surface 210. The apparatus 10 is supported by an axially-joined first wheel 64*a* and a second wheel 64*b* located near the front of the housing assembly 20. The apparatus 10 is also supported by a first caster 80*a* and a second caster 80*b* located near the rear of the housing assembly 20. The housing assembly 20 is capable of being pushed across the ground surface 210 in a manner similar to a hand-powered lawn mower, while gathering pet feces 220 previously deposited upon the ground surface 210.

As used herein, the terms "first," "second," "third," etc. are used as labels to describe various elements, features, and/or components, and are not intended to impose ordinal, positional, or hierarchical requirements on the referenced items, unless other indicated. For example, such terms may be used to distinguish one (1) element from another element.

The housing assembly 20 includes both internal and external features, which pick up, fragment, and temporarily store pet feces 220. In an example construction, the housing assembly 20 includes a forwardly sloping and generally rectangular enclosure, which includes a top panel 22, a first side panel 24*a*, a second side panel 24*b*, a front panel 26, a bottom panel 28, and a rear panel 30.

In the example construction, the top panel 22 slopes slightly downward from the rear panel 30 to the front panel 26. The front panel 26 includes a convex surface to provide sufficient space around an internal pick up roller 100. The panels 22, 24*a*, 24*b*, 26, 28, 30 define an interior space containing a plurality of textured rollers 100, 130, 140, 150 (FIGS. 3 and 4), while also providing a hopper 46 to store a volume of the fragmented pet feces 220 within. The bottom panel 28 includes a pick up opening through which access is granted for the entrance of pet feces 220 into the housing assembly 20.

The housing assembly 20 includes a first access cover 27*a* and a second access cover 27*b* removably attached to respectively opposing side panels 24*a*, 24*b*. The access covers 27*a*, 27*b* are retained in a user-protective position on the housing assembly 20 by a plurality of placed fasteners 15. The access covers 27*a*, 27*b* also define respective interior spaces containing a drive train 120, as illustrated in FIG. 5, which provides for the transmission of rotary motion originating at the wheels 64*a*, 64*b*. The access covers 27*a*, 27*b* provide protective isolation of the drive train 120 from the pet feces 220 and the clothing and person of the user 200, as well as providing access and opportunity for any needed repairs or cleaning (see FIG. 4).

Figure 3:
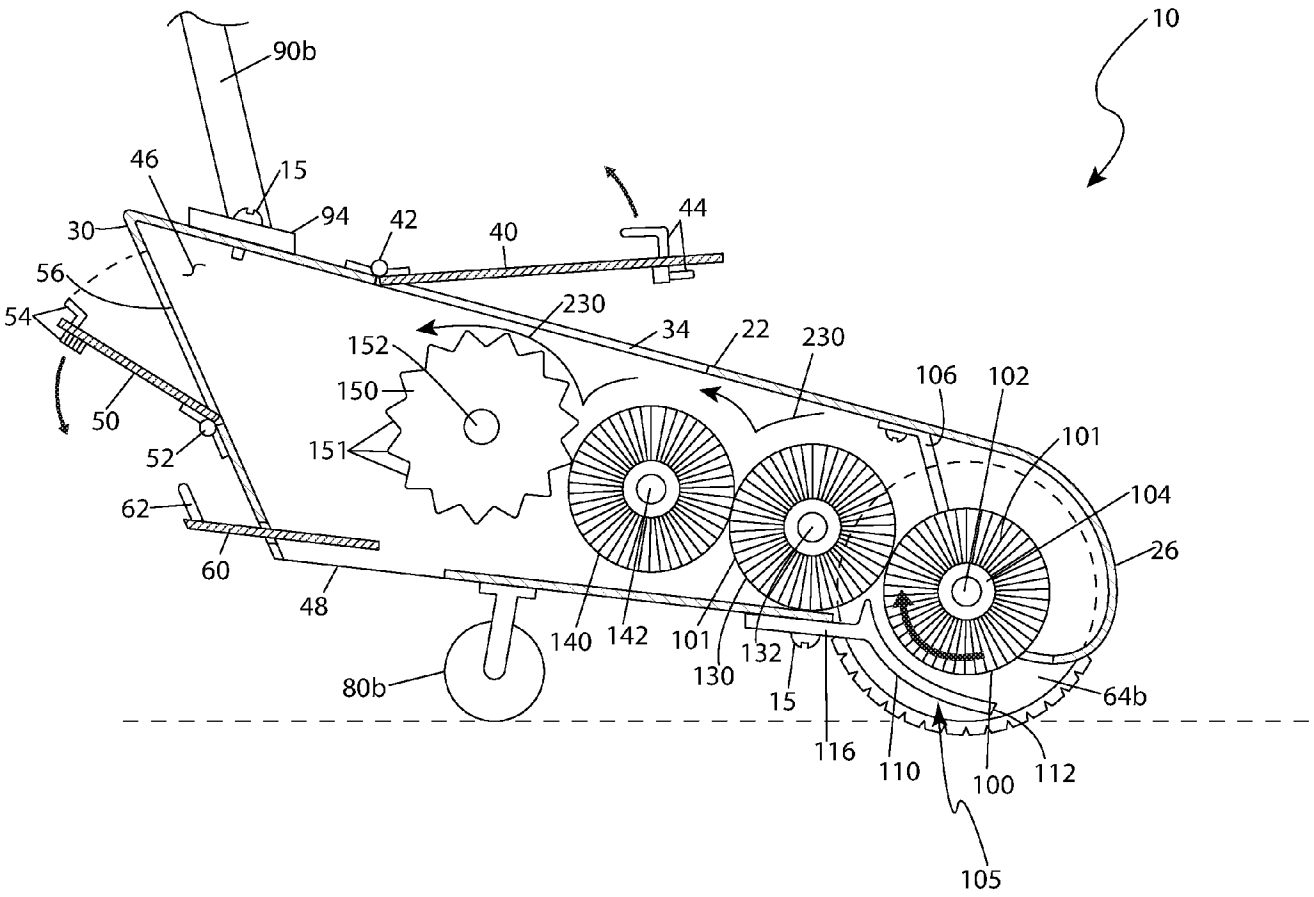
FIG. 3 is a schematic sectional view of the pet waste collection apparatus taken along section line A-A of FIG. 1, according to a preferred embodiment of the present invention.

The housing assembly 20 further includes a top door 40 and a rear door 50 to access the interior space of the housing assembly 20 for servicing and/or cleaning internal portions (see FIG. 3). The housing assembly 20 also provides a means to release and distribute a fragmented form of the pet feces 220 upon the subjacent ground surface 210 via a hopper 46 having a bottom hopper opening 48 (also see FIG. 3).

The housing assembly 20 is envisioned to roll along the ground surface 210 in a relatively smooth manner via the aforementioned front first wheel 64*a* and front second wheel 64*b*, for example, which are located at front corners of the housing assembly 20, and the rear first caster 80*a* and rear second caster 80*b*, for example, which are located slightly forward of the hopper 46 and extend downwardly to the ground surface 210.

In an example construction, the casters 80*a*, 80*b* are commercially available components that provide an unrestricted rotation in at least two (2) axes to provide a means to steer and to propel the apparatus 10. The wheels 64*a*, 64*b* are joined via a front axle 102 that is attached to the housing assembly 20 and extends between the wheels 64*a*, 64*b* and passing laterally through the housing assembly 20. The front wheels 64*a*, 64*b* and front axle 102 provide rotary transmission of forces to drive the feces 220 collection and fragmentation equipment located within the housing assembly 20 (see FIG. 4).

Those skilled in the art will recognize that ordinary provisions are made for the support, connection, and rotary motion of the wheels 64*a*, 64*b* and the front axle 102, such as bearings and the like, without limitation. The wheels 64*a*, 64*b* also include an aggressive tread 68, for example, being integrally molded in or otherwise affixed to a circumferential surface of each wheel 64*a*, 64*b* to improve traction and avoid slipping upon the ground surface 210 during use (see FIG. 3).

In one (1) example construction, the push handle 92 is attached to the housing assembly 20 along a rear portion of the top panel 22 via a pair of mounting brackets 94 and attaching fasteners 15. The mounting brackets 94 in turn include integral and upwardly protruding first push handle support 90*a* and second push handle support 90*b*, respectively.

In the example construction, the push handle supports 90*a*, 90*b* protrude upwardly from the mounting brackets 94 and are angled slightly in a rearward direction. As an example, the push handle 92 is permanently affixed to respective top end portions of the push handle supports 90*a*, 90*b* in a perpendicular manner to form a rigid "T"-shaped structure. As one (1) example, the push handle supports 90*a*, 90*b* and push handle 92 are made of a tubular metal construction that form a rigid structure utilizing welding or other equivalent metal joining techniques.

Referring to FIGS. 1-3, the apparatus 10 includes a collector assembly 105 having an arcuate collector plate 110 attached to the front of the housing assembly 20 and an integral mounting flange 116 that is attached to the bottom panel 28, for example, using fasteners 15. The collector plate 110 extends downwardly from the mounting flange 116 and in a forward curving direction until parallel to the ground surface 210. The collector 105 is attached to the bottom panel 28 in proximity to the pick-up roller 100. The collector plate 110 includes a front edge 112 oriented parallel to the subjacent ground surface 210, which enables the collector plate 110 to pass over ground cover 212, such as grass, that may be present upon the ground surface 210.

In an example implementation of use, as the apparatus 10 is propelled across the ground surface 210, the arcuate collector plate 110 lifts and transports any pet feces 220 upwardly toward the superjacent pick up roller 100 being integral to, and attached to a central portion of the front axle 102. The pick-up roller 100 includes a cylindrical member having a surface covered with bristles 101. The bristles 101 in turn convey the pet feces 220 upwardly and into the housing assembly 20 where it is subsequently fragmented and collected (see FIG. 3).

Figure 4:
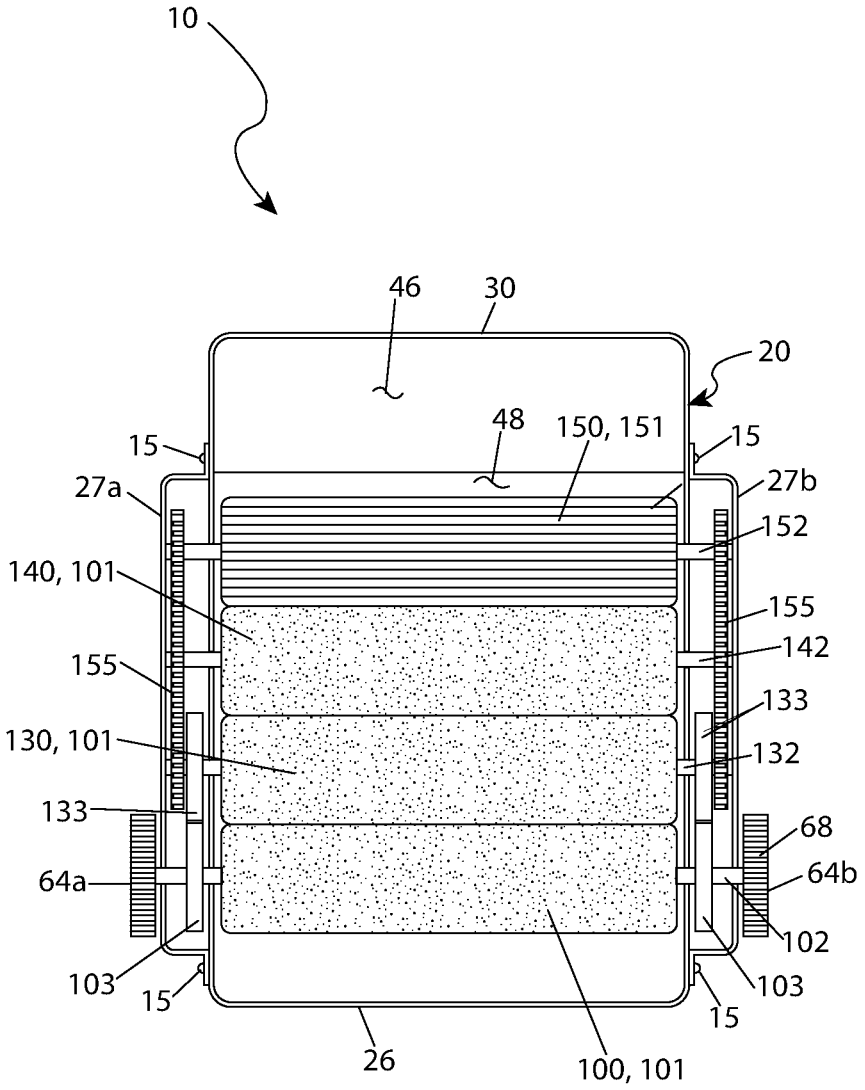
FIG. 4 is a schematic sectional view of the pet waste collection apparatus taken along section line B-B of FIG. 1, according to a preferred embodiment of the present invention; and, FIG. 5 is a schematic operational diagram of a gear train of the pet waste collection apparatus, in accordance with a preferred embodiment of the present invention.
Figure 5:
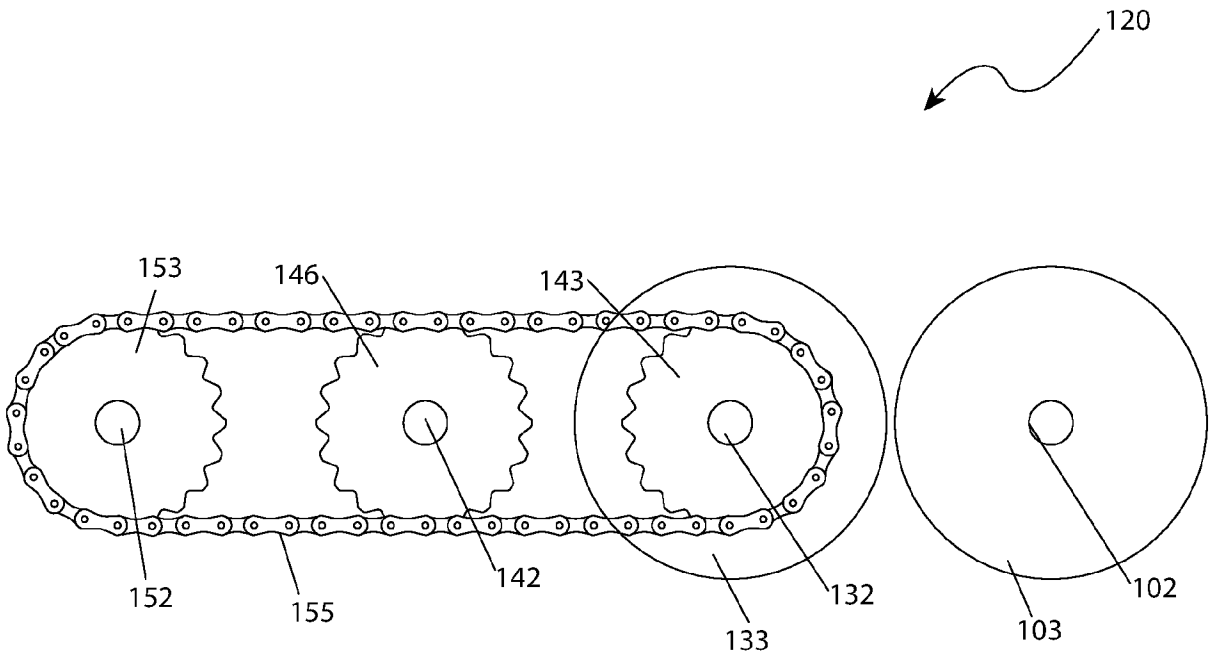

Referring now to FIGS. 3 and 4, sectional views of the apparatus 10, according to the preferred embodiment of the present invention, are disclosed. The apparatus 10 is configured to fragment pet feces 220 having been extracted from the ground surface 210 by the collector plate 110 and transferred into the housing assembly 20 by the pick-up roller 100.

In an example construction, the pick-up roller 100 includes the plurality of rigid or semi-rigid, natural or synthetic bristles 101, for example being integrally molded into or otherwise permanently affixed to a roller body 104. The front axle 102 passes through the pick-up roller 100 and extends uniformly from both ends. The pick-up roller 100 is attached to the front axle 102 by any conventional attachment device, such as tapered bushings, flanges, or threaded connections. The bristles 101 extend outwardly in a radial manner from the roller body 104 acting to contact and transfer the pet feces 220 from the collector plate 110 into the interior of the housing assembly 20.

The apparatus 10 is also configured to extract residual pet feces 220 from the bristles 101 of the pick-up roller 100 via the pick-up arm 106 that is, for example, attached to an inner surface of the top plate 22, for example by a plurality of fasteners 15.

In an example implementation, during use, the bristles 101 are acted upon by the pick-up arm 106, which is approximately the same width as the pick-up roller 100, to extract and redirect any residual pet feces 220 that may remain attached to the bristles 101.

The pet feces 220 progress through the housing assembly 20 in a travel path 230 across a plurality of progressive fragmentation rollers 130, 140, and 150 that are intended to have the cumulative effect of reducing the pet feces 220 into smaller particles. Thus, the fragmented pet feces 220 have a resultant reduced particle size and is temporarily accumulated within the rear hopper 46 of the housing assembly 20, and positioned over the hopper opening 48.

The embodiment of the apparatus 10 illustrated and described herein includes a plurality of fragmentation rollers 130, 140, 150 having a first roller shaft 132, a second roller shaft 142, and a third roller shaft 152, respectively. In this embodiment, the fragmentation rollers 130, 140, 150 are mechanically driven by the drive train 120 (FIG. 5) as the wheels 64*a*, 64*b* rotate upon the ground surface 210.

Referring to FIGS. 4 and 5, in an example construction, the front axle 102 of the pick-up roller 100 communicates rotational motion to a pair of first gears 103 attached to each end of the front axle 102. The roller shafts 132, 142, and 152 extend through the side panels 28*a*, 28*b* of the housing assembly 20 and are configured to be aligned along a longitudinal axis through the centers. Each first gear 103 is engaged with a second gear 133 attached to ends of the first roller shaft 132 of the first fragmentation roller 130. The connection between the first gear 103 and the second gear 133 results in a rotary motion of the second gear 133, and the attached first roller shaft 132, and the first fragmentation roller 130 in a direction counter to the pick-up roller 100, the front axle 102, and the first gear 103.

Referring still to FIGS. 4 and 5, in an example construction, the drive train 120 includes a first sprocket 143, a second sprocket 146, and a third sprocket 153, all mechanically connected by a drive chain 155 (see FIG. 5). The first sprocket 143 is attached to the first roller shaft 132, for example, by a connection to a tapered bushing, retaining rings set in a splined or keyed shaft, or the like. The first sprocket 143 is located in a laterally outboard position relative to the second gear 133 and may, in some embodiments, share a mutual connection thereto. The second sprocket 146 is attached to the second roller shaft 142. The third sprocket 153 is attached to the third roller shaft 152.

In an example construction, the sprockets 143, 146, 153 are commercially available components available in a variety of pitches as necessary for the suitable transmission of drive forces. Similarly, the drive chain 155 is a commercially available roller chain supplied in corresponding pitches and having the requisite number of links, or partial links, as necessary to encircle the sprockets 143, 146, 153. This arrangement of sprockets 143, 146, 153 and drive chain 155 preserves the desired direction of rotation as necessary to maintain the travel path 230 of the pet feces 220 through the housing assembly 20. However, in other embodiment, the transmission of the rotational motion to the fragmentation rollers 130, 140, 150 may be accomplished using various other techniques, mechanisms, and components, and as such should not be interpreted as a limiting factor.

In an example construction, the roller shafts 132, 142, 152 extend through the side panels 28*a*, 28*b* of the housing assembly 20, thereby positioning the gears 103, 133, 143, 153 within the respective first access cover 27*a* and second access cover 27*b* that are attached to the outer surfaces of the first side panel 24*a* and second side panel 24*b* of the housing assembly 20.

In an example construction, the fragmentation rollers 130, 140, 150 are arranged to slightly contact each other, thereby conveying the pet feces 220 in a rearward direction. In one (1) example, as illustrated, the fragmentation rollers 130, 140, 150 are arranged parallel to each other along a horizontal plane along the bottom panel 28 of the housing assembly 20. The first fragmentation roller 130 and second fragmentation roller 140 include similar materials and construction as the pick-up roller 100 and also include outer bristles 101. The third fragmentation roller 150 includes an outer pulverizing surface 151 including a plurality of rigid or semi-rigid, parallel rib features. The pet feces 220 is reduced into smaller particles as it is conveyed rearwardly by the fragmentation rollers 130, 140, 150.

The housing assembly 20 provides a means to service and/or clean the internal surfaces of the housing assembly 20 via a top opening 34 and a rear opening 56. The openings 34, 36 may be secured in a closed state by a top door 40 and a rear door 50, respectively. The doors 40, 50 are configured to open and close, as desired, for example, using a top door hinge 42 and a rear door hinge 52, respectively. The top door 40 is secured in a closed position utilizing a top door latch 44. The rear door 50 is secured in a closed position utilizing a rear door latch 54. The doors 40, 50 are configured to be flush with respective portions of the housing assembly 20 and made of a similar material.

Referring to FIG. 4, in an example implementation, during use, a quantity of fragmented pet feces 220 is collected within the hopper 46 located at a rear portion of the housing assembly 20. The bottom panel 28 of the housing assembly 20 includes the hopper opening 48 located below the hopper 46 and adjacent to the third fragmentation roller 150 to selectively release and distribute a portion of the fragmented pet feces 220 from the housing assembly 20 onto the ground surface 210, when desired.

In an example construction, the hopper opening 48 includes a rectangular opening that extends laterally across the bottom panel 28 and is normally covered by a slide plate 60. The slide plate 60 may be moved rearward to expose a selected portion of the bottom hopper opening 48, thereby controlling a rate of flow of the fragmented pet feces 220, which flows from the tapered hopper 46. The slide plate 60 includes an integral inverted "U"-shaped slide plate handle 62 along an exposed rear edge, which provides a means for a user to operably position the slide plate 60.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The example embodiments of the present invention can be utilized by the common user in a simple and effortless manner with little or no training. After initial purchase or acquisition of the apparatus 10 it would be configured and utilized as indicated in FIGS. 1-5.

In one embodiment, a method of utilizing the disclosed apparatus 10 may be achieved by performing a series of steps including: acquiring an appropriate model of the apparatus 10; securing the top door 40, the rear door 50, and the slide plate 60 in their closed states using the respective top door latch 44, rear door latch 54, and slide plate handle 62; supplying sufficient motive force to propel the apparatus 10 across the ground surface 210 containing pet feces 220; allowing the collector plate 110 and pick-up roller 100 to lift and convey the pet feces 220 into the housing assembly 20; permitting the internal fragmentation rollers 130, 140, 150 to pulverize and fragment the pet feces 220; collecting a quantity of fragmented pet feces 220 within the hopper 46 of the housing assembly 20; repeating the removal of pet feces 220 from the ground surface 210, as desired; disposing of the fragmented pet feces 220 into a suitable disposal receptacle by moving the slide plate 60 to allow the fragmented pet feces 220 to be released through the hopper opening 48; and, benefiting from reduced effort required to remove and dispose of pet feces 220 from the ground surface 210, afforded a user of the apparatus 10.

Alternately, the fragmented pet feces 220 in the hopper 46 may be redistributed as a fertilizer material by selectively opening the slide plate 60 to distribute the fragmented pet feces 220 onto the ground surface 210 as the apparatus 10 is propelled across the ground surface 210.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A pet waste collection apparatus comprising:

a mobile housing assembly defining an interior;

a pick-up roller disposed within said interior, wherein said pick-up roller is configured to collect solid waste;

a pick-up arm disposed within said interior and in contact with said pick-up roller, wherein said pick-up arm removes said solid waste from said pick-up roller;

a plurality of fragmentation rollers disposed within said interior upstream from said pick-up roller, wherein said plurality of fragmentation rollers is configured to progressively break up said solid waste; and, a hopper disposed within said interior, wherein said plurality of fragmentation rollers transfer said solid waste into said hopper.

2. The apparatus of claim 1, wherein said pick-up roller comprises radially extending bristles.

3. The apparatus of claim 2, wherein at least one of said plurality of fragmentation rollers comprises said radially extending bristles.

4. The apparatus of claim 3, wherein at least one of said plurality of fragmentation rollers comprises an exterior pulverizing surface.

5. The apparatus of claim 1, further comprising a drive train mechanically interconnecting said pick-up roller and said plurality of fragmentation rollers.

6. The apparatus of claim 5, further comprising a pair of wheels rotatably connected to a front end of said housing assembly, wherein said pair of wheels and said pick-up roller share a common axle.

7. The apparatus of claim 6, further comprising a pair of casters rotatably connected to said housing assembly rearward of said pair of wheels.

8. The apparatus of claim 1, further comprising a push handle attached to said housing assembly.

9. The apparatus of claim 1, further comprising:

a hopper opening disposed in said housing assembly; and, a slide plate removably attached to said housing assembly, wherein said slide plate removably covers said hopper opening.

10. The apparatus of claim 1, further comprising a collector assembly configured to collect said solid waste from a ground surface, wherein said pick-up roller engages said collector assembly to transfer said solid waste to said plurality of fragmentation rollers.

11. The apparatus of claim 10, wherein said collector assembly comprises an arcuate collector plate positioned below said pick-up roller.

12. The apparatus of claim 11, wherein said collector plate comprises a front edge in close proximity to said ground surface.

13. The apparatus of claim 1, further comprising;

a top opening disposed in said housing assembly for accessing said pick-up roller and said plurality of fragmentation rollers; and, a top door hingedly attached to said housing assembly for removably covering said top opening.

14. The apparatus of claim 1, further comprising;

a rear opening disposed in said housing assembly for accessing said hopper; and, a rear door hingedly attached to said housing assembly for removably covering said rear opening.

15. A pet waste collection apparatus comprising:

a mobile housing assembly defining an interior;

a hopper opening disposed in said housing assembly;

a slide plate removably attached to said housing assembly, wherein said slide plate removably covers said hopper opening;

a push handle attached to said housing assembly;

an axle connected to a front of said housing assembly;

a pair of wheels connected to opposed ends of said axle;

a pair of casters rotatably connected to said housing assembly rearward of said pair of wheels;

a collector assembly attached to said housing assembly and configured to collect solid waste from a ground surface;

a pick-up roller comprising radially extending bristles disposed around said axle within said interior, wherein rotation of said wheels causes rotation of said pick-up roller, and wherein said pick-up roller is configured to engage said collector assembly;

a pick-up arm disposed within said interior and in contact with said bristles of said pick-up roller, said pick-up arm removes said solid waste from said pick-up roller;

a plurality of fragmentation rollers disposed within said interior and upstream from said pick-up roller, wherein said pick-up roller is configured to transfer said solid waste from said collector assembly to said plurality of fragmentation rollers, and wherein said plurality of fragmentation rollers is configured to progressively break up said solid waste;

a drive train mechanically interconnecting said pick-up roller and said plurality of fragmentation rollers, wherein rotation of said pick-up roller causes rotation of said plurality of fragmentation rollers; and, a hopper disposed within said interior and upstream from said plurality of fragmentation rollers, wherein said plurality of fragmentation rollers transfer said solid waste into said hopper;

wherein said collector assembly comprises an arcuate collector plate positioned below said pick-up roller;

wherein said collector plate comprises a front edge in close proximity to said ground surface;

wherein:

at least one of said plurality of fragmentation rollers comprises said radially extending bristles; and, at least one of said plurality of fragmentation rollers comprises an exterior pulverizing surface.

* * * * *